US007913660B2

(12) United States Patent
Komura et al.

(10) Patent No.: US 7,913,660 B2
(45) Date of Patent: Mar. 29, 2011

(54) CYLINDER HEAD

(75) Inventors: Keisuke Komura, Okazaki (JP); Toshihiko Oka, Anjo (JP); Kenichi Morishima, Okazaki (JP); Norio Takayasu, Kyoto (JP)

(73) Assignees: Mitsubishi Jidosha Kogyo Kabushiki Kaisha, Tokyo (JP); Mitsubishi Jidosha Engineering Kabushiki Kaisha, Okazaki-Shi, Aichi (JP)

( * ) Notice: Subject to any disclaimer, the term of this patent is extended or adjusted under 35 U.S.C. 154(b) by 116 days.

(21) Appl. No.: 12/143,245

(22) Filed: Jun. 20, 2008

(65) Prior Publication Data

US 2009/0084340 A1 Apr. 2, 2009

(30) Foreign Application Priority Data

Sep. 27, 2007 (JP) ..... P2007-252145

(51) Int. Cl.
*F02F 1/24* (2006.01)

(52) U.S. Cl. ..... 123/193.5; 123/90.27

(58) Field of Classification Search ..... 123/193.5, 123/90.27, 90.33, 193.6
See application file for complete search history.

(56) References Cited

U.S. PATENT DOCUMENTS

| | | | | |
|---|---|---|---|---|
| 4,951,622 | A * | 8/1990 | Takahashi et al. | 123/193.5 |
| 5,038,732 | A * | 8/1991 | Matayoshi et al. | 123/193.5 |
| 6,138,631 | A * | 10/2000 | Stromsky et al. | 123/193.5 |
| 6,948,470 | B2 * | 9/2005 | Tsutsumi et al. | 123/193.5 |

FOREIGN PATENT DOCUMENTS

| | | |
|---|---|---|
| JP | UM-A-3-17245 | 2/1991 |
| JP | 6-299807 | 10/1994 |
| JP | 2544959 | 8/1997 |
| JP | 3263118 | 12/2001 |
| JP | 3263118 B2 | 12/2001 |

* cited by examiner

*Primary Examiner* — M. McMahon
(74) *Attorney, Agent, or Firm* — Birch, Stewart, Kolasch & Birch, LLP

(57) ABSTRACT

A cylinder head includes: a bottom wall; an outer circumferential wall defining inside thereof a disposition space where valves which open and close combustion chambers, rocker arms, a camshaft which actuates the rocker arms, and a rocker arm shaft which supports the rocker arms are disposed; a longitudinal; a lateral wall, integrally formed with the longitudinal wall and the outer circumferential wall; a camshaft support, formed on the lateral wall; a rocker arm shaft support, formed on the lateral wall in such a manner that a height of the rocker arm shaft is shifted from a height of the camshaft; and a head bolt boss, formed on the bottom wall to overlap the lateral wall in a height direction. The lateral wall includes a passage through which a head bolt is passed into the head bolt boss and which overlaps the head bolt boss in the height direction.

2 Claims, 6 Drawing Sheets

CYLINDER HEAD

This Nonprovisional application claims priority under 35 U.S.C. §119(a) on Patent Application No(s). 2007-252145 filed in Japan on Sep. 27, 2007, the entire contents of which are hereby incorporated by reference.

BACKGROUND OF THE INVENTION

1. Field of the Invention

The present invention relates to a cylinder head of an engine.

2. Description of the Related Art

In general, a cylinder head of an engine is built on an upper side of a cylinder block with head bolts, and intake valves for opening and closing intake ports of combustion chambers, exhaust valves for opening and closing exhaust ports of the combustion chambers, a camshaft and rocker arms which actuate the intake and exhaust valves to open and close the intake and exhaust ports, a rocker arm shaft which supports the rocker arms and the like are provided on the cylinder head. The rotation of a crankshaft is transmitted to the camshaft via timing gears or a timing belt.

A plurality of camshaft support portions for supporting the camshaft rotatably and a plurality of rocker arm shaft support portions for supporting the rocker arm shaft rotatably are provided on the cylinder head. Specifically, these camshaft support portions and rocker arm support portions are each formed into a concave shape (a semi-circular shape) for accommodating the shafts and their journal portions for support. These shaft support portions are disposed along axial directions of the shafts.

On the other hand, as has been described above, the cylinder head is fixed to the cylinder block with the head bolts. A plurality of head bolt boss portions are formed on an upper surface of the bottom wall portion of the cylinder head in positions where the head bolts are passed.

Incidentally, a space is necessary on the periphery of the head bolt boss portion for a head bolt tightening tool to be inserted. Because of this, a relatively wide space is secured on the periphery of the head bolt boss portion.

The cylinder head tends to be enlarged in size as the camshaft support portions, the rocker arm shaft support portions and the head bolt boss portions are formed in the interior thereof and the spaces need to be secured on the peripheries of the head bolt boss portions as described above. However, it is required from the viewpoint of reducing the overall size of the engine to arrange the shaft support portions and the head bolt boss portions in such an appropriate way as to suppress the enlargement of the cylinder head.

For example, Japanese Patent No. 3263118 can be raised as disclosing a construction which can realize the reduction in size of the cylinder head. In Japanese Patent No. 3263118, there is proposed a devised positional relationship between supporting structures and head bolts.

In Japanese Patent No. 3263118, lower bearing members are installed on and between left and right support walls which are provided on an upper surface of a cylinder head in such a manner as to be erected therefrom. Cam caps are installed on the lower bearing members, and a camshaft is supported between the lower bearing members and the cam caps. Head bolts are disposed between the support walls, and spaces are secured between the head bolts and the support walls so that the head bolts are inserted and removed therethrough. The cylinder head is fastened to a cylinder block using the head bolts, and thereafter, the lower bearing members are built on and between the support walls.

In the construction disclosed in Japanese Patent No. 3263118, the lower bearing members and the head bolts are overlapped each other in a height direction, whereby the reduction in size of the cylinder head is realized.

On the other hand, in addition to the reduction in its size, it is required for the cylinder head to ensure a sufficient rigidity, and to make this happen, reinforcement portions such as ribs are provided. However, in the event that such high rigidity is attempted to be realized in the construction disclosed in Japanese Patent No. 3263118, separately from the support walls which are disposed in consideration of ensuring the head bolt insertion and removal spaces, reinforcement portions such as ribs need to be disposed within the cylinder head. It is considered that the disposition of such ribs in the cylinder head makes it difficult to reduce the size of the engine to a sufficiently small level.

In addition, since the structures for supporting the camshaft on the cylinder head are provided on a bottom wall of the cylinder head in such manner as to be erected integrally therefrom, it is considered that the supporting structures themselves function to reinforce the cylinder head to make it highly rigid. However, in the camshaft supporting structures disclosed in Japanese Patent No. 3263118, since the construction is adopted in which the support wall and the lower bearing member are made up of the separate parts, the strength is reduced compared to an integral construction, and the function as the reinforcement portion of the cylinder head is reduced.

Furthermore, in the event that the support wall and the lower bearing member are made up of the separate parts as with the construction disclosed in Japanese Patent No. 3263118, an increase in production costs is called for due to an increase in the number of parts involved.

SUMMARY OF THE INVENTION

It is therefore an object of the invention to provide a cylinder head which can be made compact while increasing its rigidity.

In order to achieve the object, according to the invention, there is provided a cylinder head, comprising:

a bottom wall portion, disposed on a side which faces a cylinder block;

an outer circumferential wall portion, erected from a circumference of the bottom wall portion, and defining inside thereof a disposition space where opening and closing valves which open and close combustion chambers, rocker arms which are brought into abutment with the opening and closing valves, a camshaft which actuates the rocker arms, and a rocker arm shaft which supports the rocker arms are disposed;

a longitudinal wall portion, extending along the camshaft within the disposition space, and both ends of which are integrally formed with the outer circumferential wall portion;

a lateral wall portion, one end of which is integrally formed with the longitudinal wall portion, and the other end of which is integrally formed with a portion of the outer circumferential wall portion which confronts the longitudinal wall portion;

a camshaft support portion, formed on the lateral wall portion for supporting the camshaft;

a rocker arm shaft support portion, formed on the lateral wall portion for supporting the rocker arm shaft in such a manner that a height position of the rocker arm shaft from the bottom wall portion is positioned to be shifted from a height position of the camshaft from the bottom wall portion; and a head bolt boss portion, formed on the bottom wall portion in such a manner as to overlap the lateral wall portion in a height direction from the bottom wall portion, and an interior of which a head bolt is passed through for fixing the bottom wall portion to the cylinder block in such a state that the bottom wall portion confronts the cylinder block, wherein the lateral wall portion includes a passage portion through which the head bolt is passed into the head bolt boss portion and which overlaps the head bolt boss portion in the height direction.

The rocker arm shaft support portion may be lower than the camshaft support portion in the height direction.

The longitudinal wall portion may include an injector holding portion for holding an injector for supplying fuel to interiors of the combustion chambers.

The head bolt boss portion may overlap the camshaft support portion in the height direction. A portion of the lateral wall portion on which the camshaft support portion may be formed is thicker than the other portion of the lateral wall portion. The passage portion may be disposed between both edge portions of the portion of the lateral wall portion in a thickness direction.

The rocker arm shaft support portion may be disposed between the camshaft support portion and the bottom wall portion in the height direction.

BRIEF DESCRIPTION OF THE DRAWING

The present invention will become more fully understood from the detailed description given hereinbelow and the accompanying drawings which are given by way of illustration only, and thus are not limitative of the present invention and wherein.

DETAILED DESCRIPTION OF THE INVENTION

Figure 1:
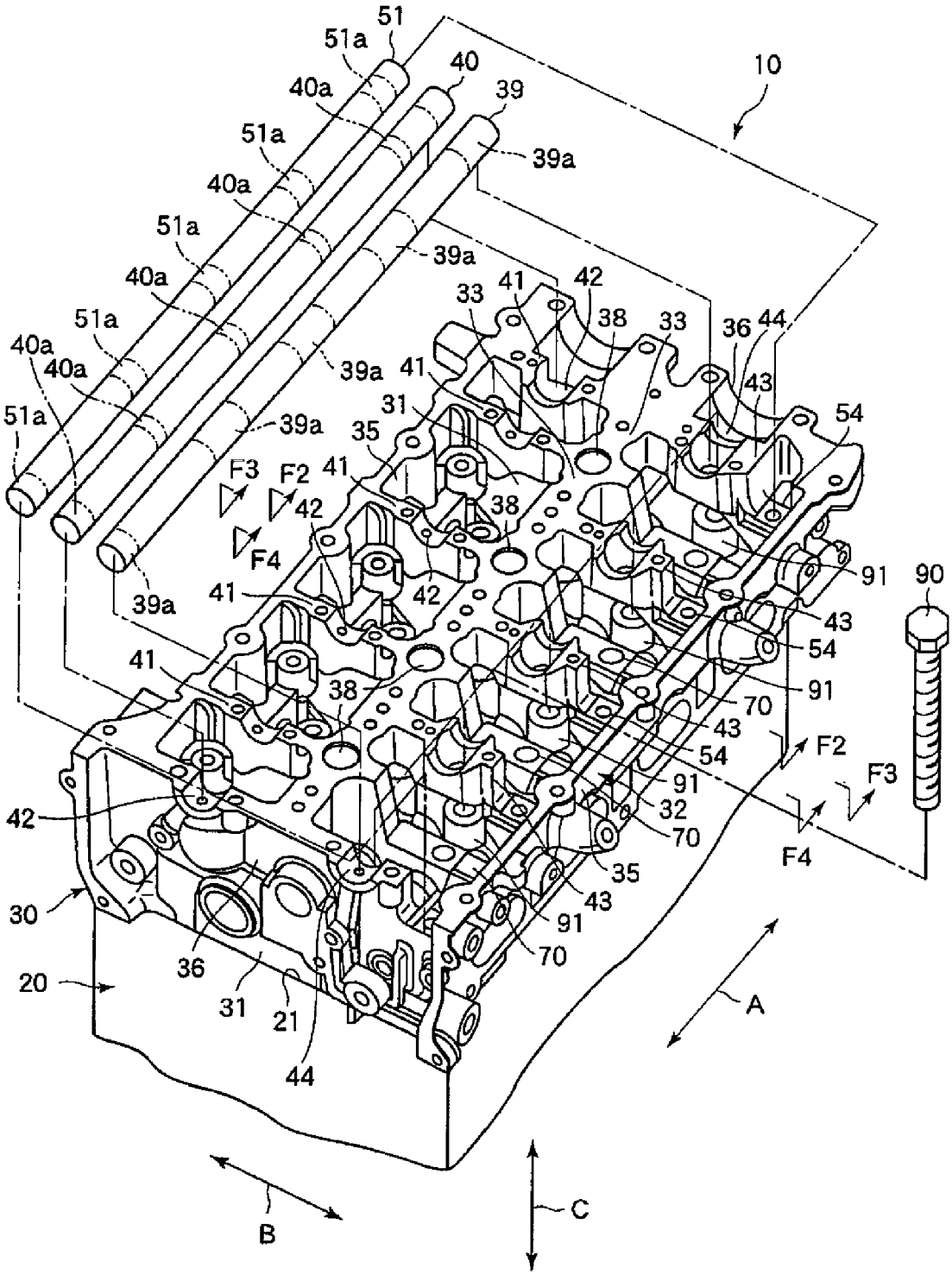
FIG. 1 is a perspective view schematically showing an engine which includes a cylinder head according to an embodiment of the invention.

A cylinder head according to an embodiment of the invention will be described using FIGS. 1 to 6. FIG. 1 is a perspective view showing schematically an engine 10 which includes a cylinder head 30 of the embodiment.

Figure 5:
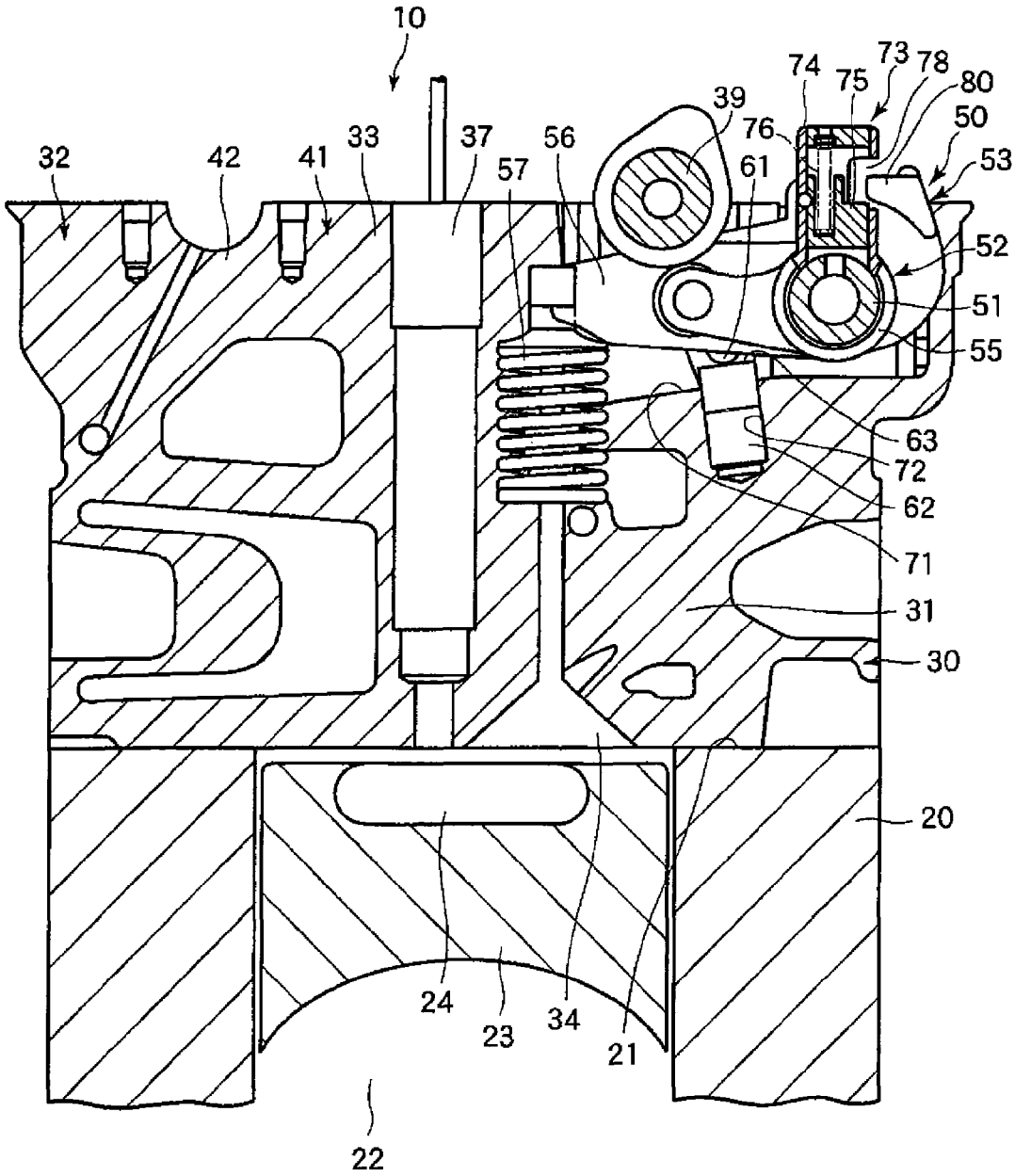
FIG. 5 is a sectional view of the engine showing a state in which an intake camshaft and a rocker arm mechanism are built on the cylinder head shown in FIG. 4.

As is shown in FIG. 1, the engine is, for example, an in-line four-cylinder diesel engine. The engine 10 includes a cylinder block 20 and a cylinder head 30. FIG. 5 is a sectional view showing schematically an interior of the cylinder block 20. As is shown in FIG. 5, cylinders 22 are formed within the cylinder block 20. Pistons 23 are accommodated in the cylinders 22. Connecting rods, not shown, are connected to the pistons 23, respectively, and these connecting rods are connected to a crankshaft, not shown.

Combustion chambers 24 are formed between the respective pistons 23 and the cylinder head 30, which will be described later. The pistons 23 are put in motion by energy produced within the combustion chambers 24 in the power stroke, and such motions of the pistons 23 are transmitted to the crankshaft by the connecting rods, as a result of which the crankshaft rotates.

As is shown in FIG. 1, the cylinder head 30 is disposed on a deck surface 21 of the cylinder block 20 to which the cylinders 22 are made to open. A seal member such as a gasket, not shown, is interposed between the cylinder block 20 and the cylinder head 30.

The cylinder head 30 is fixed to the cylinder block 20 with head bolts such as a head bolt 90 shown in a right-hand edge portion of the figure. The fixing construction of the cylinder head 30 to the cylinder block 20 using the head bolds 90 will be described in detail later.

Figure 2:
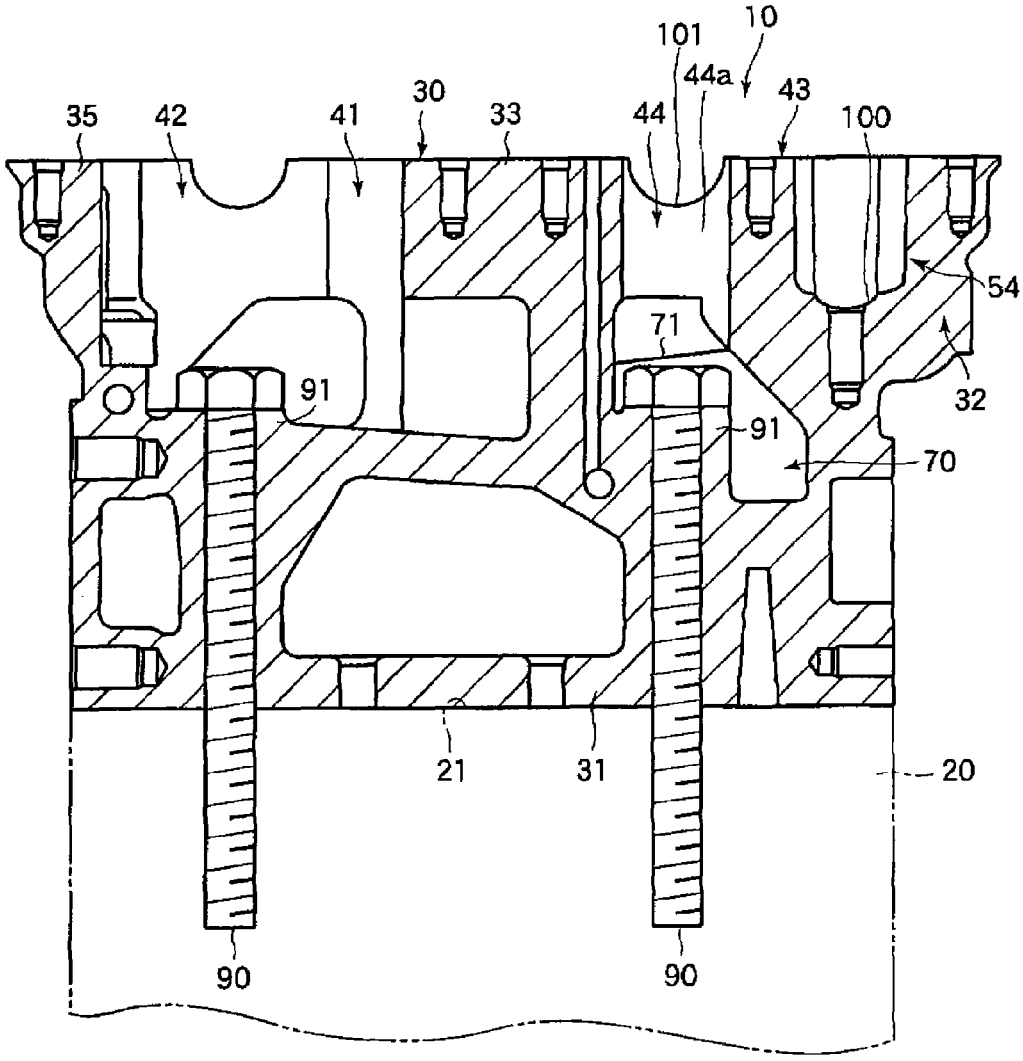
FIG. 2 is a sectional view of the engine taken along the line F2-F2 shown in FIG. 1.

FIG. 2 is a sectional view of the engine taken along the line F2-F2 shown in FIG. 1. FIG. 2 shows a section of the engine which results when the engine is sectioned in a direction which extends across the crankshaft. Note that in FIG. 2, only the outline of the cylinder block 20 is shown by a chain double-dashed line. In addition, the illustration of intake and exhaust camshafts 39, 40 and rocker arm mechanisms 50, which will be described later, is omitted.

As is shown in FIGS. 1, 2, the cylinder head 30 includes an opening which is opened to a side opposite to a side which faces the cylinder block 20. For example, a head cover, not shown, is placed on the opening in the cylinder head 30. As is shown in FIGS. 1, 2, the cylinder head 30 has a bottom wall portion 31, an outer circumferential wall portion 32 and a longitudinal wall portion 33.

As is shown in FIG. 2, the bottom wall portion 31 is disposed on the side of the cylinder head 30 which faces the deck surface 21 of the cylinder block 20 and constitutes a base portion of the cylinder head 30.

As is indicated by arrows in FIG. 1, a direction in which the respective combustion chambers 24 are aligned, that is, a direction in which the crankshaft extends is made to be a longitudinal direction A of the engine 10, and a direction which extends across the direction in which the respective combustion chambers 24 are aligned is made to be a width or transverse direction B of the engine 10. A direction in which the cylinder block 20 and the cylinder head 30 are aligned (a direction in which the cylinder block 20 and the bottom wall portion 31 are aligned) is made to be a vertical direction C of the engine 10, and the cylinder head 30 is positioned to lie above the cylinder block 20. Note that in this embodiment, the vertical direction C is parallel to a height direction from the bottom wall portion 31.

The outer circumferential wall portion 32 is erected, for example, substantially in the vertical direction from a circumferential edge portion of the bottom wall portion 31 and continues in a circumferential direction. The outer circumferential wall portion 32 defines an inside and an outside of the cylinder head 30 and has outer longitudinal wall portions 35 which extend substantially along the longitudinal direction A and external lateral wall portions 36 which extend substantially along the transverse direction B.

The longitudinal wall portion 33 is disposed substantially centrally of the cylinder head 30 in the transverse direction B and extends along the longitudinal direction A. In addition, the longitudinal wall portion 33 is formed integrally with the bottom wall portion 31 in such a manner as to be erected substantially in the vertical direction C and is formed integrally with the outer lateral wall portions 36 at both ends thereof in the longitudinal direction A.

As is shown in FIG. 1, a plurality of injector holding boss portions 38, adapted to hold injectors 37 (shown in FIG. 5) for injecting fuel into the combustion chambers, are formed on the longitudinal wall portion 33. The injector holding boss portions 38 are formed to correspond individually to the combustion chambers. The bottom wall portion 31, the circumferential wall portion 32 and the longitudinal wall portion 33 are formed integrally.

Intake valves 34 (partially shown in FIG. 5), exhaust valves, an intake camshaft 39 and an exhaust camshaft 40 which are actuated by the rotation of the crankshaft being transmitted thereto, rocker arm mechanisms 50 (partially shown in FIG. 4) and the like are built in the cylinder head 30. Note that these intake valves 34, exhaust valves, intake and exhaust camshafts 39, 40 and rocker arm mechanisms 50, as well as the injectors 37 described above are examples of parts that are built in the cylinder head 30.

The intake valve 34 is provided in an intake port which communicates with the combustion chamber 24. The exhaust valve (not shown) is provided in an exhaust port which communicates with the combustion chamber 24.

As is shown in FIG. 1, the intake camshaft 39 and the exhaust camshaft 40 rotate to actuate the intake valves 34 and the exhaust valves by the rotation of the crankshaft being transmitted thereto. The intake camshaft 39 is disposed on an intake side (a right-hand side in the figure) of the engine 10, so as to actuate the rocker arm mechanisms 50. The exhaust camshaft 40 is disposed on an exhaust side (a left-hand side in the figure) of the engine 10, so as to actuate the exhaust valves. Note that both the intake and exhaust camshafts 39, 40 are schematically shown in FIG. 1.

Supporting structures for supporting the intake and exhaust camshafts 39, 40 and the rocker arm mechanisms 50 are provided on the cylinder head 30. The supporting structures will be described specifically.

Firstly, a construction for supporting the exhaust camshaft 40 will be described. A plurality of exhaust side lateral wall portions 41 for supporting the exhaust camshaft 40 are formed on an exhaust side of the cylinder head 30. The exhaust side lateral wall portions 41 are formed in such a manner as to extend in the transverse direction B between the longitudinal wall portion 33 and the outer longitudinal wall portion 35 which is disposed on the exhaust side of the cylinder head 30 (the outer longitudinal wall portion 35 which is disposed on the left-hand side of the cylinder head 30 as viewed in FIG. 1). The exhaust side lateral wall portions 41 are disposed in positions where they lie adjacent to the injector holding boss portions 38 and are formed integrally with the longitudinal wall portion 33 at one ends while formed integrally with the outer longitudinal wall portion 35 at the other ends thereof.

Figure 3:
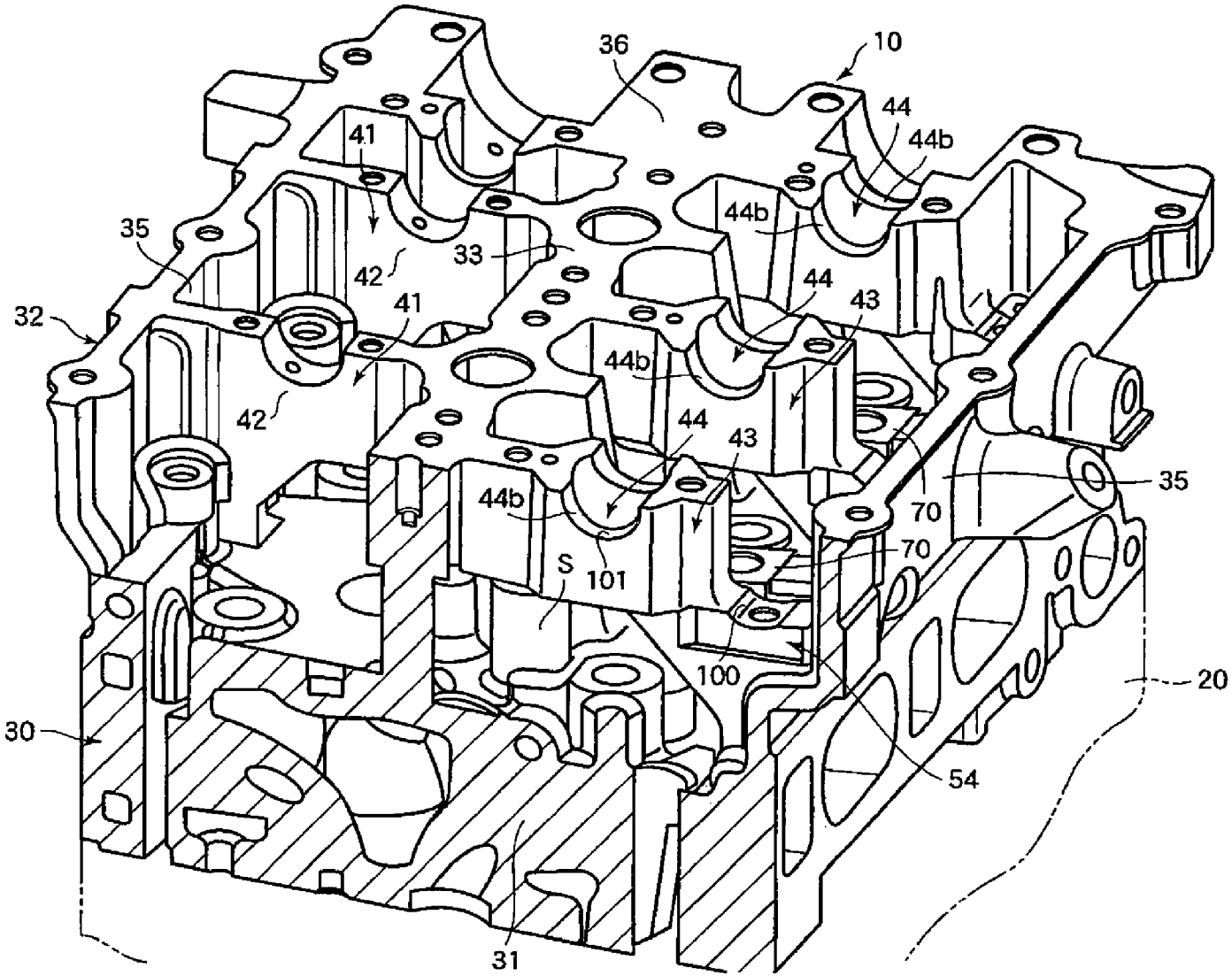
FIG. 3 is a perspective view showing the engine sectioned along the line F3-F3 shown in FIG. 1.

In the sectional view shown in FIG. 2, the exhaust side lateral wall portion 41 is not sectioned but is shown as viewed from the front. In addition, FIG. 3 is a perspective view showing the engine 10 which is sectioned along the line F3-F3 shown in FIG. 1. Note that in these figures, only the outline of the cylinder block 20 is shown by a chain double-dashed line. In addition, the illustration of the intake and exhaust camshafts 39, 40 and rocker arm mechanisms 50 is omitted.

As is shown in FIGS. 2, 3, the exhaust side lateral wall portion 41 is formed integrally with the bottom wall portion 31 near end portions thereof. In the exhaust side lateral wall portion 41, a space is formed between a portion other than the end portions and the upper surface of the bottom wall portion 31.

As is shown in FIG. 1, exhaust camshaft support portions 42 are formed on the exhaust side lateral wall portions 41 for supporting journals 40*a* of the exhaust camshaft 40. The exhaust camshaft support portion 42 is formed in cross section into a concave shape which is cut out semi-circularly and accommodates therein the journal 40*a* of the exhaust camshaft 40. Note that in FIG. 1, the journals 40*a* of the exhaust camshaft 40 are portions shown by chain double-dashed lines.

The exhaust camshaft 40 is supported on the cylinder head 30 by the journals 40*a* being supported on the exhaust camshaft support portions 42. The plurality (four in this embodiment) of exhaust side lateral wall portions 41 is formed to be aligned in the longitudinal direction in such a manner that one exhaust side lateral wall portion 41 supports one of the journals 40*a* of the exhaust camshaft 40. In addition, exhaust camshaft support portions 42 are also formed on the outer lateral wall portions 36 for supporting end portions of the exhaust camshaft 40.

Next, supporting structures of the intake camshaft 39 and the rocker arm mechanisms 50 will be described. As is shown in FIG. 1, first intake side lateral wall portions 43 are formed on an intake side of the cylinder head 30 in such a manner as to extend in a straight line in the transverse direction B.

FIG. 3 is the perspective view in which none of the first intake side lateral wall portion 43 is sectioned. As is shown in FIG. 3, the first intake side lateral wall portions 43 are formed in such a manner as to extend between the longitudinal wall portion 33 and the outer longitudinal wall portion 35 which is disposed on the intake side of the cylinder head 30 (the outer longitudinal wall portion 35 which is disposed on the right-hand side of the cylinder head 30 as viewed in FIG. 1).

The plurality of first intake side lateral wall portions 43 is formed in such a manner that one first intake side lateral wall portion 43 is disposed in a substantially central position between the injector holding boss portions 38 which lie adjacent to each other in the longitudinal direction A. In this embodiment, four first intake side lateral wall portions 43 are formed. The first intake side lateral wall portions 43 are formed integrally with the longitudinal wall portion 33 at one ends while formed integrally with the outer longitudinal wall portion 35 at the other ends thereof.

The first intake side lateral wall portion 43 has an intake camshaft support portion 44 for supporting a journal 39*a* of the intake camshaft 39. The intake camshaft support portion 44 is formed on a side of the first intake side lateral wall portion 43 which faces the longitudinal wall portion 33. The intake camshaft support portion 43 is formed in cross section into a concave shape which is cut out semi-circularly and accommodates therein the journal 39*a* of the intake camshaft 39.

Thus, as has been described above, the intake camshaft 39 is supported on the cylinder head 30 by being supported within the intake camshaft support portions 44. Note that in FIG. 1, the journals 39*a* of the intake camshaft 39 are portions indicated by chain double-dashed lines. The plurality of first intake side lateral wall portions 43 is disposed to be aligned in the longitudinal direction A in such a manner that one first intake side lateral wall portion 43 supports one of the journals 39*a* of the intake camshaft 39. In addition, intake camshaft support portions 44 are also formed on the outer lateral wall portions 36 in a similar fashion for supporting both ends of the intake camshaft 39.

Figure 4:
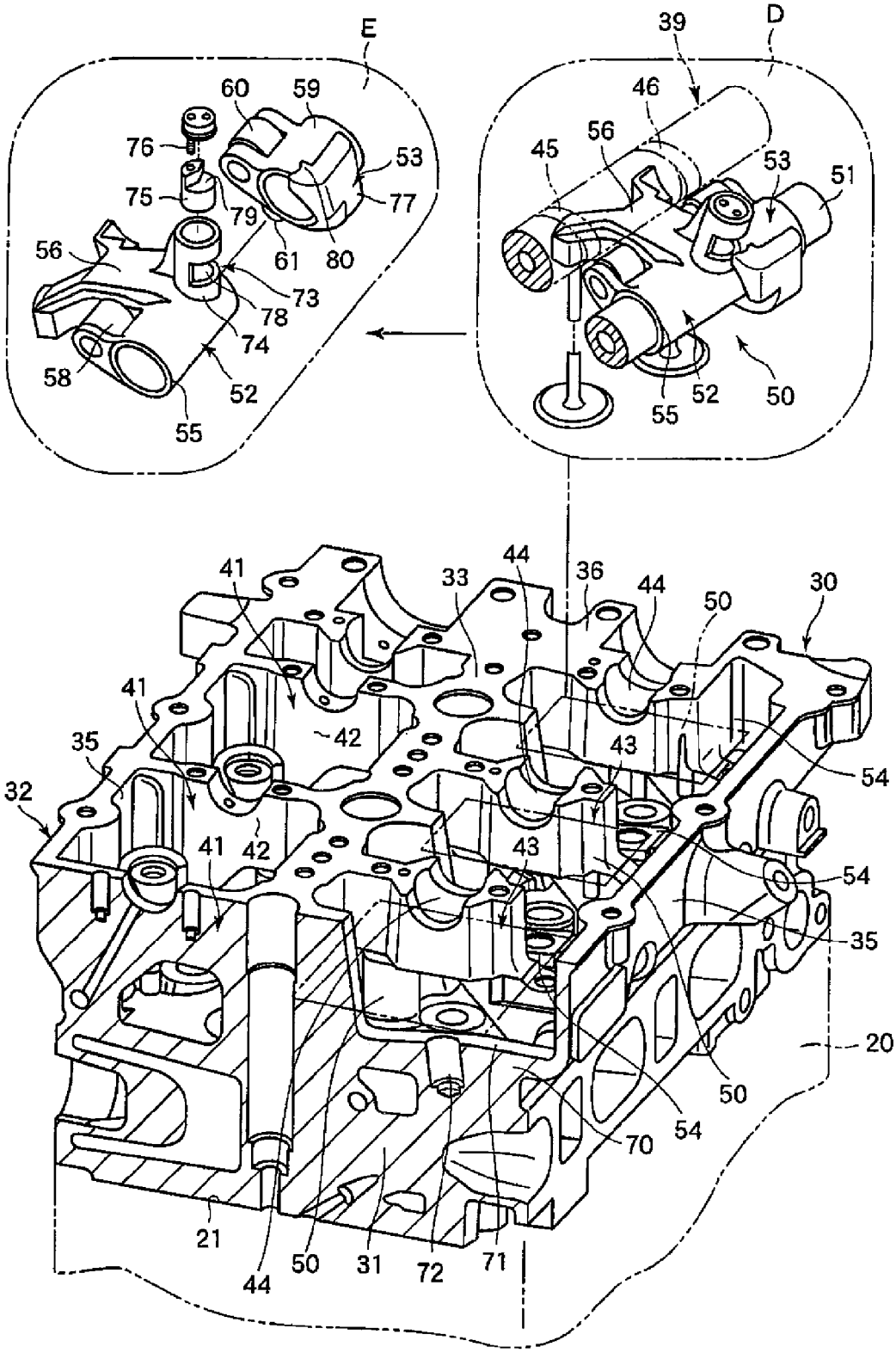
FIG. 4 is a perspective view showing the engine sectioned along the line F4-F4 shown in FIG. 1.

FIG. 4 is a perspective view showing the engine 10 which is sectioned along the line F4-F4 shown in FIG. 1. In FIG. 4, the exhaust side lateral wall portion 41 is sectioned. Note that in the figure, the illustration of the intake and exhaust camshafts 39, 40 and the rocker arm mechanisms 50 is emitted. In addition, only the outline of the cylinder block 20 is indicated by a chain double-dashed line.

As is shown in FIG. 4, the rocker arm mechanisms 50 are disposed between the longitudinal wall portion 33 and the intake-side outer longitudinal wall portion 35. As is indicated by chain double-dashed lines in FIG. 4, the rocker arm mechanisms 50 are disposed between the first intake side lateral wall portions 43.

The rocker arm mechanism 50 is of variable type in which the intake valve 34 is driven variably in association with the running state of the engine 10. In addition, two intake valves 34 are used for one combustion chamber 24. The intake valves 34 are aligned in, for example, in the longitudinal direction A. The intake valve 34 is an example of an opening and closing valve.

In FIG. 4, one of the rocker arm mechanisms 50 which corresponds to one cylinder is shown in an enlarged fashion in an area D surrounded by a chain double-dashed line. As is shown in the area D, a low-speed cam 45 and a high-speed cam 46 are formed on the intake camshaft 39.

The low-speed cam 45 actuates the intake valve 34 at a valve opening and closing timing which is suitable for the low-speed running of the engine 10 and has a cam profile which can provide a valve lift amount which is suitable for such a low-speed running. The high-speed cam 46 actuates the intake valve 34 at a valve opening and closing timing which is suitable for the high-speed running of the engine 10 and has a cam profile which can provide a valve lift amount which is suitable for such a high-speed running.

The rocker arm mechanism 50 includes a rocker arm shaft 51, a low-speed rocker arm 52 and a high-speed rocker arm 53. As is shown in FIG. 1, the rocker arm shaft 51 is disposed on the intake side of the cylinder head 30. As is shown in FIGS. 1 to 4, rocker arm shaft support portions 54 are formed on the first intake side lateral wall portions 43 for supporting the rocker arm shaft 51.

The rocker arm shaft support portion 54 is disposed on the first intake side lateral wall portion 43 in a position which lies adjacent to the intake camshaft support portion 44 and in the proximity to its end which faces the outer longitudinal wall portion 35. Consequently, the rocker arm shaft support portion 54 is disposed in the position which lies adjacent to the intake camshaft support portion 44 in the transverse direction B.

The rocker arm shaft support portion 54 is formed in cross section into a concave shape which is cut out semi-circularly for accommodating therein a journal 51*a* of the rocker arm shaft 51. In FIG. 1, the journal 51*a* is a portion indicated by a chain double-dashed line. The rocker arm shaft support portions 54 accommodate the rocker arm shaft 51 inside thereof. The rocker arm shaft 51 is supported on the cylinder head 30 by the journals 51*a* thereof being supported by the rocker arm shaft support portions 54. One rocker arm shaft support portion 54 supports one of the journals 51*a* of the rocker arm shaft 51.

In addition, a receiving surface 100 of the rocker arm shaft support portion 54 which supports the rocker arm shaft 51 is positioned further downwards than a receiving surface 101 of the intake camshaft support portion 44 which supports the intake camshaft 39. Namely, the rocker shaft support portion 54 is disposed further downwards (towards the cylinder block 20) than the intake camshaft support portion 44.

This will be described specifically. FIG. 5 is a sectional view of the engine 10 which shows a state in which the intake camshaft 39 and the rocker arm mechanisms 50 are built on the cylinder head 30 shown in FIG. 4. In addition, FIG. 5 is the sectional view taken along the line F4-F4 shown in FIG. 1.

As is shown in FIG. 5, the locker arm shaft support portion 54 is formed such that in such a state that the locker arm shaft support portion 54 supports the rocker arm shaft 51, the rocker arm shaft 51 is disposed further downwards than the intake camshaft 39 (in a position where the low-speed cams 45 and the high-speed cams 46 do not interfere with the rocker arm shaft 51).

By being disposed in the position which is shifted downwards relative to the intake camshaft 39, the rocker arm shaft 51 is allowed to be disposed inwards (towards the longitudinal wall portion 33) of the cylinder head 30 while preventing the interference thereof with the low-speed cams 45 and the high-speed cams 46.

In addition, the arrangement in which the intake camshaft 39 and the rocker arm mechanisms 50 are disposed in such a manner as to overlap each other in the vertical direction can be realized by the locker arm shaft 51 being disposed below the intake camshaft 39.

As is shown in FIG. 3, below the first intake side lateral wall portion 43, a space S is formed between the intake camshaft support portion 44 and the bottom wall portion 31.

In FIG. 4, a state in which the rocker arm mechanism 50 is exploded is shown in an area E indicated by a chain double-dashed line. As is shown in FIG. 4, the low-speed rocker arm 52 has a low-speed boss portion 55 and a low-speed arm portion 56.

The low-speed boss portion 55 is formed into a cylindrical tube shape, and the rocker arm shaft 51 is passed through an interior thereof. The low-speed boss portion 55 is made to rotate relative to the rocker arm shaft 51. The low-speed arm portion 56 is formed on the low-speed boss portion 55 in such a manner as to extend from the low-speed boss portion 55 towards the intake valve 34.

A distal end of the low-speed arm portion 56 is bifurcated substantially into a Y-shape and each of the bifurcated portions actuates one intake valve 34. In addition, as is shown in FIG. 5, the intake valve 34 is constructed to open the intake port when it is depressed and is normally urged in a direction in which it closes the intake port (in a direction in which it is depressed) by, for example, a coil spring 57.

As is shown in FIG. 4, a low-speed roller member 58 is provided on the low-speed arm portion 56. The low-speed roller member 58 is disposed below the low-speed cam 45, and the low-speed cam 45 is made to be brought into abutment with the low-speed roller member 58.

The low-speed roller member 58 is urged to be brought into abutment with the low-speed cam 45 at all times by the low-speed arm portion 56 being urged (depressed) by the coil spring 57 of the intake valve 34. Because of this, the low-speed roller member 58 is displaced while following the cam profile of the low-speed cam 45 when the intake camshaft 39 rotates, whereby the low-speed rocker arm 52 is actuated to rotate on the rocker arm shaft 51 as a fulcrum.

The high-speed rocker arm 53 is supported on the rocker arm shaft 51 and is disposed adjacent to the low-speed rocker arm 52 along the rocker arm shaft 51. The high-speed rocker arm 53 includes a high-speed boss portion 59 and a high-speed roller member 60.

The high-speed boss portion 59 is disposed adjacent to the low-speed boss portion 55. The high-speed boss portion 59 is formed into a cylindrical tube shape, and the rocker arm shaft 51 is passed through an interior thereof. The high-speed boss portion 59 is made to rotate freely relative the rocker arm shaft 51.

The high-speed roller member 60 is provided on the high-speed boss portion 59 and is disposed below the high-speed cam 46. The high-speed cam 46 is in abutment with the high-speed roller member 60. An abutment portion 61 is formed at a lower end portion of the high-speed rocker arm 53. The abutment portion 61 is formed into a downwardly projecting shape.

As is shown in FIG. 5, a push-up member 62 is brought into abutment with the abutment portion 61 from the side of the cylinder block 20. The push-up member 62 is made to extend and contract over its overall length and is constructed to incorporate therein a spring member. An upper end face 63 of the push-up member 62 urges the abutment portion 61 upwardly by the upper end face 63 being urged by the spring member.

Because of this, since the high-speed roller member 60 is made to be in abutment with the high-speed cam 46 at all times, the high-speed roller member 60 is displaced while following the cam profile of the high-speed cam 46 when the intake camshaft 39 rotates. As a result, the high-speed rocker arm 53 is actuated to rotate on the rocker arm shaft 51 as a fulcrum.

The push-up member 62 is provided on a second intake side lateral wall portion 70. As is shown in FIGS. 1, 4, the second intake side lateral wall portion 70 is formed to extend in the transverse direction B between the longitudinal wall portion 33 and the outer longitudinal wall portion 35. The periphery of the second intake side lateral wall portion 70 is formed integrally with the longitudinal wall portion 33, the bottom wall portion 31 and the outer longitudinal wall portion 35.

An upper end face 71 of the second intake side lateral wall portion 70 is positioned below the abutment portion 61. An accommodation hole 72 is bored in the upper end face 71 of the second intake side lateral wall portion 70 for accommodating therein the push-up member 62.

A switching mechanism 73 is provided between the high-speed rocker arm 53 and the low-speed rocker arm 52 which switches between the transmission of displacement of the high-speed rocker arm 53 to the intake valve 34 and the transmission of displacement of the low-speed rocker arm 52 to the intake valve 34. The switching mechanism 73 includes a storage tubular portion 74, a piston 75, a coil spring 76, a transmission arm 77 and a hydraulic mechanism, not shown.

The storage tubular portion 74 is provided on the low-speed boss portion 55. The storage tubular portion 74 is formed into a tubular shape. A window portion 78 is formed in part of a back side portion of the storage tubular portion 74 which is opposite to a side thereof which confronts the intake camshaft 39 by cutting out the portion in question. The storage tubular portion 74 communicates with the outside thereof through the window portion 78.

The piston 75 is stored in the storage tubular portion 74. As is shown in the figure, a cut-out portion 79 is formed in an upper end portion of the piston 75 by cutting partially the upper end portion. The window portion 78 is positioned on a low-speed boss portion 55 side (downwards) of the storage tubular portion 74.

When the piston 75 is positioned on the low-speed boss portion 55 side, the cut-out portion 79 is exposed to the outside through the window portion 78. In addition, when the piston 75 moves to an upper end side (a side opposite to the low-speed boss portion 55) of the storage tubular portion 74, the cut-out portion 79 is covered any other portion (a wall portion) than the window portion 78 on a back side portion thereof.

The coil spring 76 is stored within the storage tubular portion 74 and is disposed between the piston 75 and the upper end of the storage tubular portion 74. Because of this, the piston 75 is urged downwards (towards the low-speed boss portion 55) by the coil spring 76. Consequently, the cut-out portion 79 is normally made to be exposed to the outside through the window portion 78.

The transmission arm 77 is formed on the high-speed boss portion 59. A distal end 80 of the transmission arm 77 is formed in such a manner as to enter the interior of the storage tubular portion 74 through the window portion 78 in association with the rotation of the high-speed rocker arm 53.

Because of this, when the piston 75 is positioned such that the cut-out portion 79 confronts the window portion 78, the distal end 80 of the transmission arm 77 is in no case brought into abutment with the piston 75 through the window portion 78, whereby the distal end 80 of the transmission arm 77 can enter the interior of the storage tubular portion 74. Consequently, since the high-speed rocker arm 53 is put in a state in which it oscillates idly, the rotational displacement of the high-speed rocker arm 53 is not transmitted to the low-speed rocker arm 52.

When the piston 75 is positioned such that the window portion 78 is covered by the piston 75 (the portion thereof other than the cut-out portion 79), the transmission arm 77 is allowed to be brought into abutment with the piston 75. As a result of this, the rotational displacement of the high-speed rocker arm 53 is transmitted to the low-speed rocker arm 52 via the piston 75. The lift amount of the intake valve 34 by the high-speed cam 46 is larger than the lift amount thereof by the low-speed cam 45. Because of this, the rotational displacement of the high-speed rocker arm 53 is made to be transmitted to the intake valve 34 via the low-speed rocker arm 52.

The hydraulic mechanism has a function to push up the piston 75 against the elastic force of the coil spring 76. The hydraulic mechanism switches positions of the piston 75 in accordance with the running state of the engine 10.

The hydraulic mechanism does not urge the piston 75 when the engine 10 is in the low-speed running state. Because of this, since the cut-out portion 79 is made to confront the window portion 78, the rotational displacement of the high-speed rocker arm 53 is not transmitted to the low-speed rocker arm 52, whereby the intake valve 34 is actuated by the low-speed rocker arm 52.

When the engine 10 is in the high-speed running state, the hydraulic mechanism urges the piston 75, whereby since the cut-out portion 79 is dislocated from the window portion 78, the window portion 78 being covered by the portion of the piston 75 other than the cut-out portion 79, the rotational displacement of the high-speed rocker arm 53 is transmitted to the low-speed rocker arm 52 via the transmission arm 77 and the piston 75. As a result of this, the intake valve 34 is actuated by the high-speed rocker arm 53.

Next, a fixing construction of the cylinder head 30 to the cylinder block 20 will be described specifically. As is shown in FIG. 1, the cylinder head 30 is fixed to the cylinder block 20 with the head bolts 90. A plurality of head bolt boss portions 91 is formed on the bottom wall portion 31.

Figure 6:
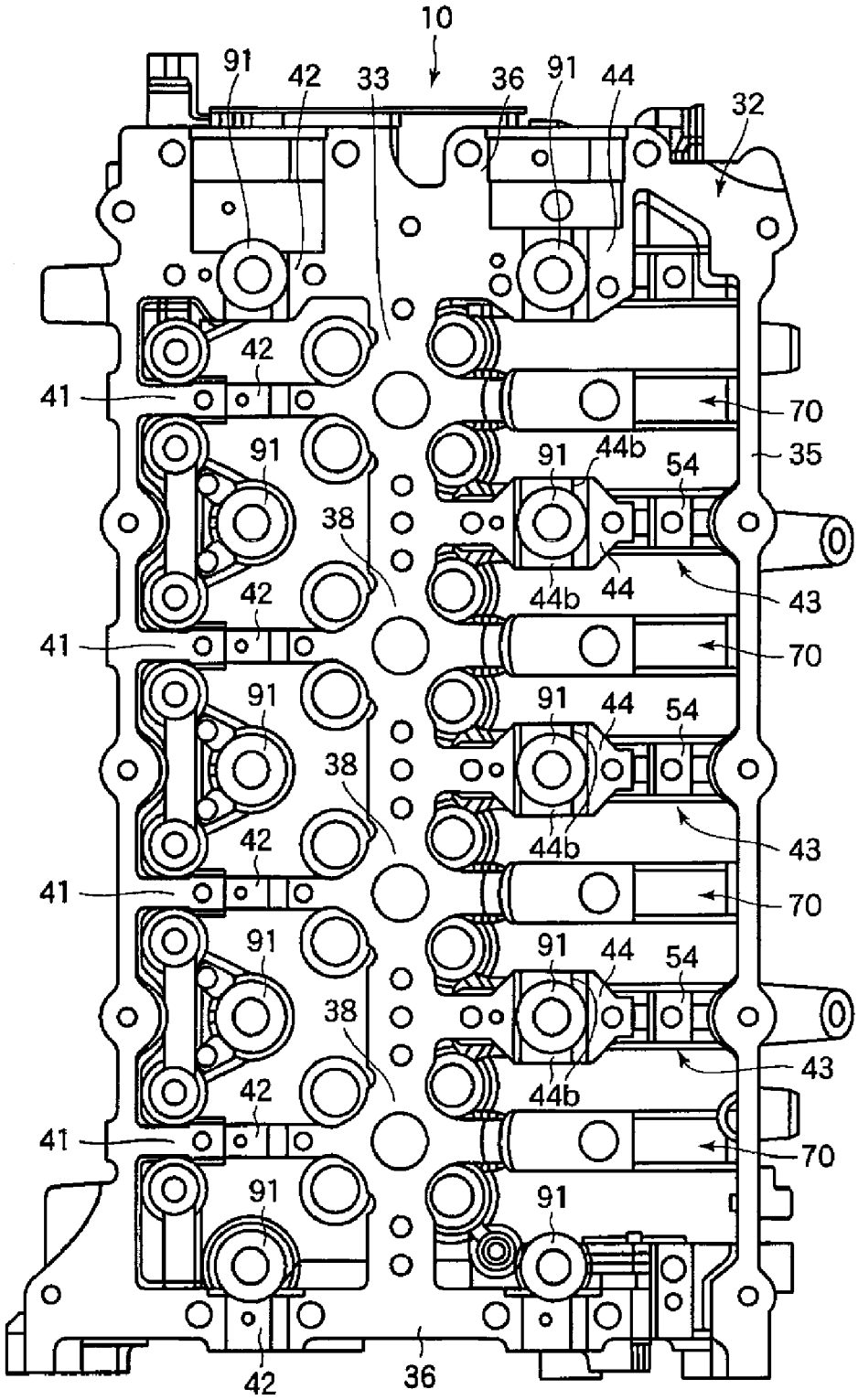
FIG. 6 is a plan view showing the cylinder head shown in FIG. 1.

FIG. 6 is a plan view showing the cylinder head 30. As is shown in FIG. 6, head bolt boss portions 91 which are disposed on the exhaust side of the cylinder head 30 are disposed in such a manner that one head bolt boss portion 91 is disposed between the adjacent exhaust side lateral wall portions 41 in the longitudinal direction A. Because of this, a sufficient working space for inserting the head bolt 90 into the head bolt boss portion 91 can be secured on the periphery of the head bolt boss portion 91 so disposed.

Head bolt boss portions 91 are also disposed below the exhaust camshaft support portions 42 which are formed on the outer lateral wall portions 36. In the exhaust camshaft support portion 42 formed on the outer lateral wall portion 36, a passage hole through which the head bolt 90 and a tool used for head bolt tightening work are passed is formed in a portion which overlaps the head bolt boss portion 91 in the vertical direction C. Consequently, the head bolt 90 and the tool used for the head bolt tightening work can be inserted from above through the exhaust camshaft support portion 42.

FIG. 2 is the sectional view taken along the plane which passes through the first intake side lateral wall portion 43. As is shown in FIGS. 2, 6, head bolt boss portions 91 which are disposed on the intake side of the cylinder head 30 are disposed below the camshaft support portions 44 formed on the first intake side lateral wall portions 43.

As is shown in FIGS. 3, 4, 6, when viewed from the top, the intake camshaft support portion 44 which is formed on the first intake side lateral wall portion 43 is formed thicker in the longitudinal direction A than the other portions of the first intake side lateral wall portion 43 than the intake camshaft support portion 44. In addition, a passage hole (a passage portion) 44*a* is formed between both edge portions 44*b* of the intake camshaft support portion 44 in the longitudinal direction A in such a manner as to reach the head bolt boss portion 91. The intake-side head bolt boss portion 91 is exposed in such a manner as to be accessed from above through the passage hole 44*a*.

The passage hole 44*a* is sized to allow the passage of the head bolt 90 and the tool used when the head bolt 90 is built into the head bolt boss portion 91. Thus, a space is secured on the periphery of the intake-side head bolt boss portion 91 which is necessary to build the head bolt 90 into the head bolt boss portion 91.

In addition, the intake camshaft support portion 44 which is formed on one of the other outer lateral wall portions 36 is also constructed such that a passage hole 44*a* is formed therein in a similar manner to that in which the passage hole 44*a* is formed in the intake camshaft support portion 44 formed on the first intake side lateral wall portion 43, and the head bolt 90 and the tool can also be passed therethrough.

Note that the exhaust side lateral wall portions 41 and the first and second intake side lateral wall portions 43, 70 are formed integrally when the cylinder head 30 is formed through casting, and therefore, the bottom wall portion 31, the longitudinal wall portion 33 and the circumferential wall portion 32 are made integral with each other.

In the cylinder head 30 that is configured as has been described heretofore, since the longitudinal wall portion 33 which supports the exhaust side lateral wall portions 41 and the first and second intake side lateral wall portions 43, 70 extends in the longitudinal direction A to be connected to the outer circumferential wall portion 32 at the ends thereof, the longitudinal wall portion 33 functions as a reinforcement rib of the cylinder head 30.

Because of this, the rigidity of the cylinder head 30 is increased. Furthermore, by the longitudinal wall portion 33 functioning as the reinforcement rib, the necessity is obviated of providing a separate reinforcement rib, whereby the cylinder head 30 is made compact.

Furthermore, the rigidity of the cylinder head 30 is increased by the exhaust side lateral wall portions 41 and the first and second intake side lateral wall portions 43, 70 which extend in the transverse direction B functioning as reinforcement ribs.

Moreover, the cylinder head 30 can be made compact in the transverse direction B by the rocker arm shaft 51 being positioned below the intake camshaft 39 and being disposed inwards of the cylinder head 30.

In addition, since the arrangement can be realized in which the intake camshaft 39 and the rocker arm mechanisms 50 are disposed in such a manner as to overlap each other in the vertical direction by the rocker arm shaft 51 being disposed below the intake camshaft 39, the cylinder head 30 can be made compact in the transverse direction B.

Furthermore, by disposing the head bolt boss portions 91 in the (downward) positions where they overlap the intake camshaft support portions 44 and enabling the access to the head bolt boss portions 91 through the passage holes 44*a*, not only can the cylinder head 30 be made compact but also the reduction in rigidity can be suppressed which would otherwise be caused by the intake camshaft support portions 44 being made up of separate parts.

The cylinder head 30 is made compact while increasing its rigidity by the advantages described above.

In addition, since the injector holding boss portions 38 are formed on the longitudinal wall portion 33, the necessity is obviated of providing additional injector holding boss portions 38 within the cylinder head 30. Because of this, the cylinder head 30 can be made compact.

Additionally, the intake camshaft support portions 44 support the intake camshaft 39 at their edge portions 44*b*. Because of this, the intake camshaft 39 is held while well balanced.

In addition, the head bolt boss portions 91 are disposed below the intake camshaft support portions 44 and the rocker arm shaft support portions 54 are disposed below the intake camshaft support portion 44. As a result of this, since the disposition of the rocker arm mechanisms 50 in a higher position relative to the bottom wall portion 31 is suppressed, the increase in overall height of the engine 10 is suppressed. Namely, the engine 10 is made compact.

Note that in the embodiment, the rocker arm mechanisms 50 are provided on the intake side of the cylinder head 30, and no rocker arm mechanism is provided on the exhaust side thereof. However, the rocker arm mechanisms may be provided on the exhaust side of the cylinder head 30. In this case, the positional relationship between the camshaft and the rocker arm shaft and the position of the head bolt boss portions 91 may be similar to those on the intake side. By this configuration, the same advantage can be obtained even in the event that the construction on the intake side is adopted on the exhaust side.

In addition, while the embodiment of the invention is described as being applied to the diesel engine, the invention is not limited thereto. The same advantage can be obtained even in the event that the invention is applied to a gasoline engine.

According to an aspect of the invention, the longitudinal wall portion not only supports the lateral walls but also functions as reinforcement portions of the cylinder head. By the camshaft support portions being formed on the lateral wall portions, a sufficient strength can be secured while suppressing the increase in production costs, compared with the configuration in which the shaft support portions are formed as the separate elements from the cylinder head. In addition, by the rocker arm shaft being made to be shifted from the camshaft in the height direction, for example, as to the arrangement of the rocker arms, the parts which are involved in the valve train can be disposed to overlap the camshaft in the height direction. Additionally, the lateral wall portions and the head bolt boss portions are prevented from being situated on the same plane, whereby the reduction in size of the cylinder head can be realized.

According to an aspect of the invention, the parts such as the rocker arms which are built on the rocker arm shaft can be disposed in the low position by disposing the camshaft in the position which is shifted further downwards than the rocker arm shaft in the height direction.

According an aspect of the invention, since the injector holding portions are formed by making use of the longitudinal wall portion, the necessity is obviated of providing additionally injector holding spaces within the cylinder head.

According to an aspect of the invention, since the camshaft support portions are made to support the camshaft at both the edges of the thick portions (both side portions of the passage portions), the stable support of the camshaft is realized. In addition, since the head bolts can be inserted through the passage portions from above the camshaft support portions and can be tightened by operating a tool above the camshaft support portions, the necessity is obviated of securing tool spaces for tightening and removing the head bolts within the disposition spaces inside the cylinder head, this also contributing to the reduction in the overall size of the cylinder head.

The invention thus described, it will be obvious that the same say be varied in many ways. Such variations are not to be regarded as a departure from the sprit and scope of the invention, and all such modifications as would be obvious to one skilled in the art are intended to be included within the scope of the following claims.

What is claimed is:

1. A cylinder head, comprising:

a bottom wall portion, disposed on a side which faces a cylinder block to make a base portion;

an outer circumferential wall portion, erected from a circumference of the bottom wall portion, and defining inside thereof a disposition space where opening and closing valves which open and close combustion chambers, rocker arms which are brought into abutment with the opening and closing valves, a camshaft which actuates the rocker arms, and a rocker arm shaft which supports the rocker arms are disposed;

a longitudinal wall portion, extending along the camshaft within the disposition space, and both ends of which are integrally formed with the outer circumferential wall portion;

a lateral wall portion, within the disposition space, one end of which is integrally formed with the longitudinal wall portion, and the other end of which is integrally formed with a portion of the outer circumferential wall portion which confronts the longitudinal wall portion;

a camshaft support portion having an open concave shape, the camshaft support portion formed on the lateral wall portion for supporting the camshaft;

a rocker arm shaft support portion having an open concave shape, the rocker arm shaft support portion formed on the lateral wall portion for supporting the rocker arm shaft in such a manner that a position of the rocker arm shaft is shifted from a position of the camshaft in a first direction; and a head bolt boss portion, formed on the bottom wall portion at a position under the lateral wall portion such that the head bolt boss portion overlaps the camshaft support portion in the first direction, and an interior of which a head bolt is passed through for fixing the bottom wall portion to the cylinder block in such a state that the bottom wall portion confronts the cylinder block, wherein the camshaft support portion includes a passage portion through which the head bolt is passed into the head bolt boss portion and which overlaps the head bolt boss portion in the first direction, wherein the cam shaft support portion is formed on a side of the lateral wall portion, the side of the lateral wall portion which faces the longitudinal wall portion, wherein the rocker arm shaft support portion is formed on a side of the lateral wall portion, the side of the lateral wall portion which faces the outer circumferential wall portion that confronts the longitudinal wall portion, and the rocker arm shaft support is lower than the camshaft support in the first direction, and the longitudinal wall portion is formed with injector holding portions for holding injectors for supplying fuel to interiors of the combustion chambers, each of the injector holding portions is formed for corresponding one of the combustion chambers, and the lateral wall portion is arranged between the adjacent two of the injector holding portions.

2. The cylinder head as set forth in claim 1, wherein a thickness of the camshaft support portion is greater than a thickness of a part of the lateral wall portion in a second direction perpendicular to the first direction, and the passage portion is disposed between a pair of edge portions of the camshaft support portion in the second direction.

* * * * *